US011183169B1

(12) United States Patent
Kaewtip et al.

(10) Patent No.: US 11,183,169 B1
(45) Date of Patent: Nov. 23, 2021

(54) ENHANCED VIRTUAL SINGERS GENERATION BY INCORPORATING SINGING DYNAMICS TO PERSONALIZED TEXT-TO-SPEECH-TO-SINGING

(71) Applicants: Kantapon Kaewtip, Phatthalung (TH); Fernando Villavicencio, Guadalajara (MX)

(72) Inventors: Kantapon Kaewtip, Phatthalung (TH); Fernando Villavicencio, Guadalajara (MX)

(73) Assignee: OBEN, INC., Pasadena, CA (US)

( * ) Notice: Subject to any disclaimer, the term of this patent is extended or adjusted under 35 U.S.C. 154(b) by 94 days.

(21) Appl. No.: 16/678,986

(22) Filed: Nov. 8, 2019

Related U.S. Application Data

(60) Provisional application No. 62/757,594, filed on Nov. 8, 2018.

(51) Int. Cl.

| | |
|---|---|
| ***G10L 13/047*** | (2013.01) |
| ***G10L 13/02*** | (2013.01) |
| ***G10L 13/033*** | (2013.01) |
| ***G10L 13/08*** | (2013.01) |

(52) U.S. Cl.
CPC ..... *G10L 13/047* (2013.01); *G10L 13/02* (2013.01); *G10L 13/033* (2013.01); *G10L 13/08* (2013.01); *G10H 2250/455* (2013.01)

(58) Field of Classification Search
CPC . G10H 2250/455; G10L 13/033; G10L 13/02; G10L 13/08
See application file for complete search history.

(56) References Cited

U.S. PATENT DOCUMENTS

| | | | | |
|---|---|---|---|---|
| 4,527,274 | A * | 7/1985 | Gaynor | G10L 13/02 704/260 |
| 10,008,193 | B1 * | 6/2018 | Harvilla | G10H 1/20 |
| 2003/0009336 | A1 * | 1/2003 | Kenmochi | G10L 13/07 704/258 |
| 2008/0097754 | A1 * | 4/2008 | Goto | G10L 15/26 704/214 |
| 2011/0000360 | A1 * | 1/2011 | Saino | G10H 1/361 84/622 |

(Continued)

OTHER PUBLICATIONS

Zemedu et al., "Concatenative Hymn Synthesis from Yared Notations." International Conference on Natural Language Processing. Springer, Cham, (Year: 2014).*

(Continued)

*Primary Examiner* — Samuel G Neway
(74) *Attorney, Agent, or Firm* — Andrew S. Naglestad

(57) ABSTRACT

A technique to enhance the quality of Text-to-Speech (TTS) based Singing Voice generation is disclosed. The present invention efficiently preserves the speaker identity and improves sound quality by incorporating speaker-independent natural singing information into TTS-based Speech-to-Singing (STS). The Template-based Text-to-Singing (TTTS) system merges qualities of a singing voice generated from a TTS system with qualities of a singing voice generated from an actual voice singing the song. The qualities are represented in terms of Mel-generalized cepstrum (MGC) coefficients. In particular, low-order MGC coefficients from the TTS-based singing voice with high-order MGC coefficients from the voice of an actual singer.

5 Claims, 4 Drawing Sheets

(56) References Cited

U.S. PATENT DOCUMENTS

| | | | | |
|---|---|---|---|---|
| 2011/0054902 | A1* | 3/2011 | Li | G10L 13/033 704/258 |
| 2013/0019738 | A1* | 1/2013 | Haupt | G10L 21/013 84/622 |
| 2019/0103084 | A1* | 4/2019 | Ogasawara | G10H 1/0008 |

OTHER PUBLICATIONS

Freixes et al., "Adding singing capabilities to unit selection TTS through HNM-based conversion." International Conference on Advances in Speech and Language Technologies for Iberian Languages. Springer, Cham, (Year: 2016).*

* cited by examiner

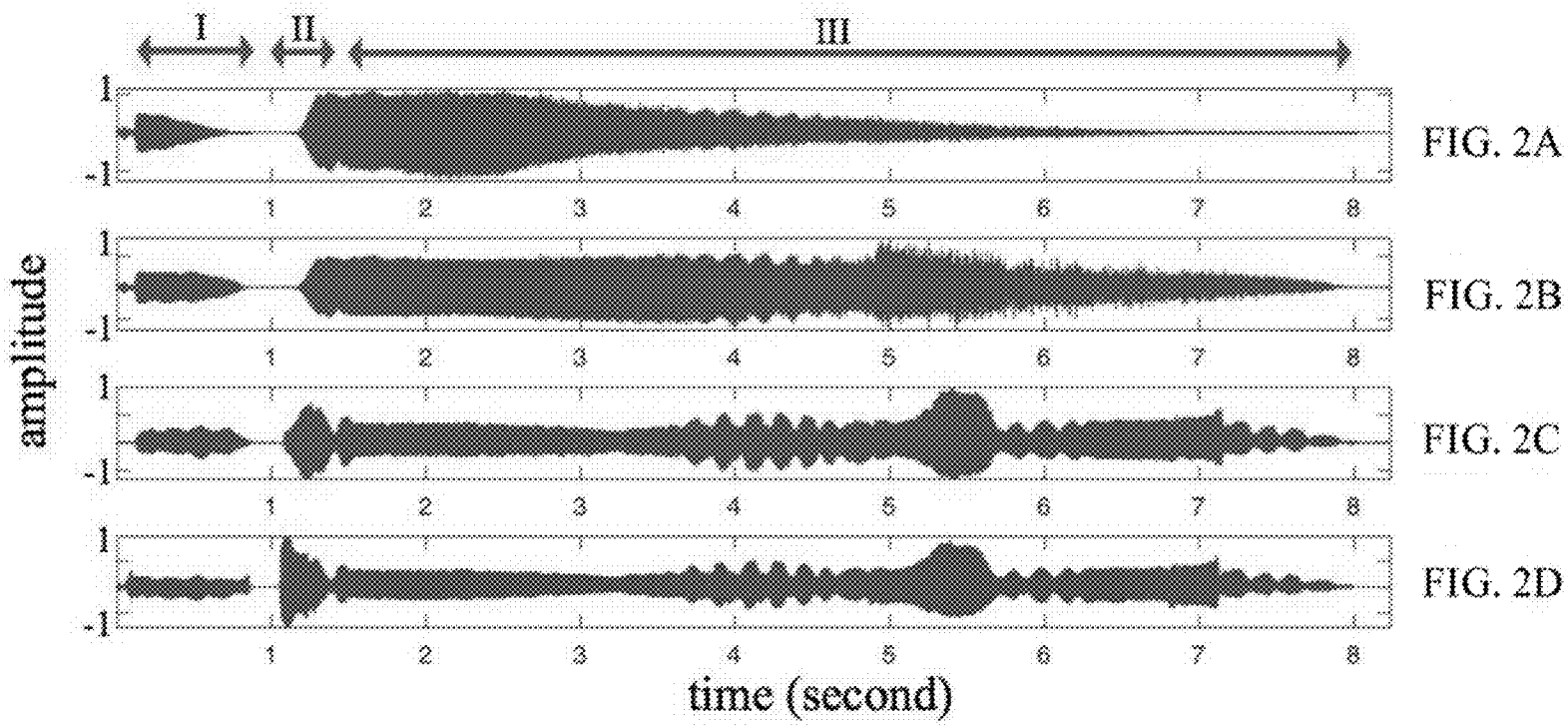
FIG. 2A
FIG. 2B
FIG. 2C
FIG. 2D
I
II
III
amplitude
time (second)
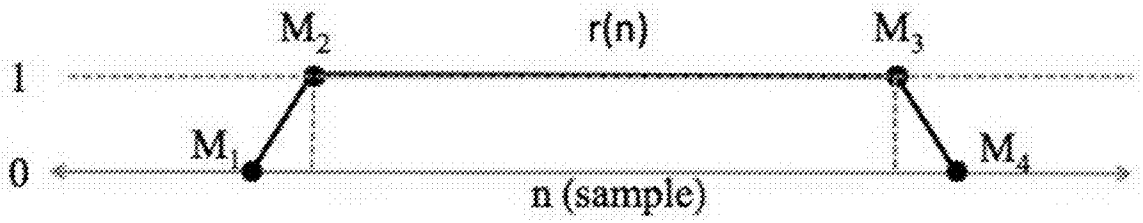
FIG. 4
r(n)
n (sample)
$M_1$
$M_2$
$M_3$
$M_4$ I
II
III
frequency (kHz)
time (second)

ENHANCED VIRTUAL SINGERS GENERATION BY INCORPORATING SINGING DYNAMICS TO PERSONALIZED TEXT-TO-SPEECH-TO-SINGING

CROSS-REFERENCE TO RELATED APPLICATION(S)

This application claims the benefit of U.S. Provisional Patent Application Ser. No. 62/757,594 filed Nov. 8, 2018, titled "Enhanced virtual singers generation by incorporating singing dynamics to personalized text-to-speech-to-singing," which is hereby incorporated by reference herein for all purposes.

TECHNICAL FIELD

The invention generally relates to a technique for generating an audio file of a person singing without the person actually singing. In particular, the invention relates to a system and method for generating an audio file of a person singing from the text of a song.

BACKGROUND

Current commercial TTS systems are able to generate high-quality speech. These systems are generally limited to the generation of spoken content of a single voice. However, an interest is emerging for techniques for performing identity transformation such as Voice Conversion and Speaker Adaptation. Although there have not been many attempts to extend TTS capacity to singing voice generation, there has been some work done in what has been referred to as a Speech-to-Singing transformation (STS). In a pioneering work, psycho-acoustical aspects referred to as vibration and ringing-ness were found to significantly affect the "singing-ness" of the voice. Although a STS schema was proposed using a music score and FD, spectral, and duration, there is still a need for a technique that provides a realistic singing voice from text.

SUMMARY

The preferred embodiment of the present invention is a technique to enhance the quality of Text-to-Speech (TTS) based Singing Voice generation. Speech-to-singing refers to techniques transforming a spoken voice into singing, mainly by manipulating the duration and pitch of a spoken version of a song's lyrics. The present invention efficiently preserves the speaker identity and improves sound quality (e.g. reducing hoarseness) by incorporating speaker-independent natural singing information into TTS-based Speech-to-Singing (STS). We use TTS as the input speech on a TSTS-like schema to build what we denote for simplicity as Template-based Text-to-Singing (TTTS) system. Moreover, we propose: 1) enhanced singing generation by integrating singer-independent features from natural singing to a baseline TTSing engine, and 2) to use a personalized TTS system (i.e. a target speaker identity is applied) as input speech so that new "virtual singers" can be easily generated from a small adaptation data.

Some embodiments of the invention also include a technique to stretch a vowel segment in such a way that is suitable for singing. Recordings of vowels enunciated at several pitch levels are acquired and their acoustic information used to enhance the timbre of the singing voice. In addition, acoustic information from a singing template is used to further balance the voicing features and energy contours to reduce hoarseness and energy fading.

BRIEF DESCRIPTION OF THE DRAWINGS

The present invention is illustrated by way of example and not limitation in the figures of the accompanying drawings, and in which:

FIGS. 2A-2D are a plurality of waveform outputs, in accordance with one embodiment of the present invention;

FIG. 4 is a ramp function used to transition between non-vowel frames and vowel frames, in accordance with one embodiment of the present invention.

DETAILED DESCRIPTION OF THE PREFERRED EMBODIMENT

Figure 1:
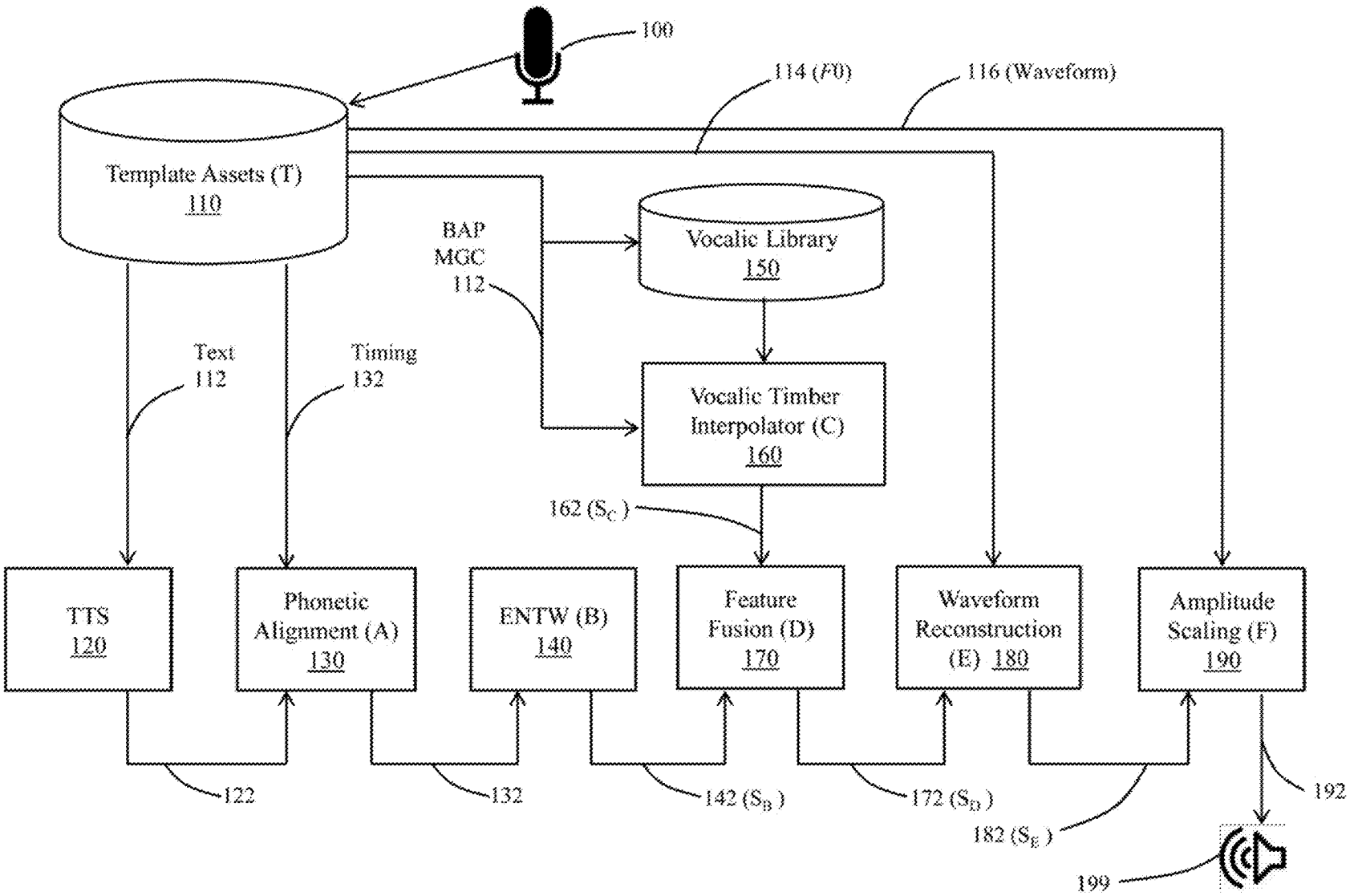
FIG. 1 is a functional block diagram of the Text-to-Singing (TTTS) system, in accordance with one embodiment of the present invention.

Illustrated in FIG. 1 is the Template-based Text-to-Singing (TTTS) system in accordance with one embodiment of the present invention. The TTTS system generates singing voices with a personalized identity using lyrics and timing information. The TTTS system includes a microphone 100, template asset database 110, text-to-speech (TTS) system 120, phonetic alignment module 130, Energy-based Non-linear Time Warping (ENTW) module 140, vocalic library 150, vocalic timbre interpolator 160, feature fusion module 170, waveform reconstruction module 180, amplitude scaling module 190, and speaker 199.

To generate a singing voice for a particular song, the TTTS system requires an acappella version of the song including singer without instrumental portion, the corresponding instrumental content, and the song lyrics. The acappella version is phonetically labeled to produce template timing including the time position of each phonetic unit. The template pitch contour is also extracted from the acappella version using SAC, which is method to estimate the pitch information from an audio file, which is a robust estimator for singing voice. SAC is taught by Emilia Gomez and Jordi Bonada in "Towards computer-assisted flamenco transcription: An experimental comparison of automatic transcription algorithms as applied to a cappella singing," published in Computer Music Journal at vol. 37, no. 2, pp. 73-90, 2013, which is hereby incorporated by reference herein. The lyrics of the song, phonetic labels, and pitch contours represent one of a plurality of singing templates collectively represented as template asset in database 110.

The lyrics 112 are transmitted to the TTS system 120 which generates data 122 including (a) phonetic timing information from the lyrics and (b) acoustic features, including Mel-generalized cepstrum (MGC), band aperiodicity (BAP), and fundamental frequency (F0) which are used in a vocoder as WORLD for waveform generation. The TTS system 120 includes a voice model that is pre-trained based on a large speaker corpus and then adapted to the voice of a particular individual. The voice model is adapted to the individual speaker voice by parameter adaptation using one hour of speech acquired with one or more microphones 100, for example. In our work, we employ the WORLD vocoder for the TTS system 120 and waveform generator. The acoustic features in WORLD include Mel-generalized cepstrum (MGC), band aperiodicity (BAP), and fundamental frequency (F0). The TTS-based features 122 generated by the TTS system 120 are then transmitted to the phonetic alignment module 130.

The phonetic alignment module 130, also referred to herein as block A, aligns the TTS-based features in duration to match the timing 132 for each phoneme in the singing template. That is, the duration of the phonemes derived from the text are aligned with the phonemes represented in the singing template. The acoustic features 132 of the phonemes after phonetic alignment are then transmitted to the ENTW module 140.

The ENTW module 140 receives the acoustic features 132 after the phonetic alignment and modifies the features so that they observe acoustic conditions more suitable for a singing voice. In particular, the ENTW module 140 applies a nonlinear time warping function d(n) to the MGC and BAP from the TTS 120 so as to elongation the vowels. In the following discussion, for any building block, say block H, notations $X_H$ and $Y_H$ refer to MGC and BAP as outputs from Block H, respectively. The first index refers to frame number and the second index refers to the MGC order for $X_H$ and BAP order for $Y_H$. Subscript T denotes the features of the template song.

In the preferred embodiment, the ENTW module 140 uniformly stretches each vowel segment to match the vowel duration of the singing template. As a result, low-energy frames found at the beginning and at the end of a segment may be elongated. In the preferred embodiment, the ENTW module 140 applies a nonlinear time warping function d(n) to MGC and BAP in such a way that vowel elongation is concentrated near the middle of a spoken vowel. It is determined to be acoustically consistent and avoids over-lengthening the border, i.e., the last section of a frame generated by the TTS in a vowel ending a word which generally exhibits lower energy and/or weaker spectral features. Utilizing the relationship of the first coefficient and the summation of the logarithmic of the filter bank energy, we approximate the relative energy contour using C0.

For a given vowel segment, let $N_1$ be the first frame and $N_2$ be the last frame of the segment, our warping function is defined as:

$$d(n) = N_1 + \frac{\sum_{m=N_1+1}^{n} e^{X_0(m,0)}}{\sum_{m=N_1+1}^{N_2} e^{X_0(m,0)}}(N_2 - N_1).$$

If d(n) is not an integer, the value of $X_B$ (d(n), k) is approximated using linear interpolation. BAP and F0 are warped in the same fashion as MGC using the same function d(n). Intuitively, the high energy frames are stretched while the lower energy frames are compressed in such a way that the segment length remains the same, as $d(N_1)=N_1$ and $d(N_2)=N_2$. The warping affects, i.e., is applied to, only vowel segments.

Figures 3A, 3B, 3C, 3D:
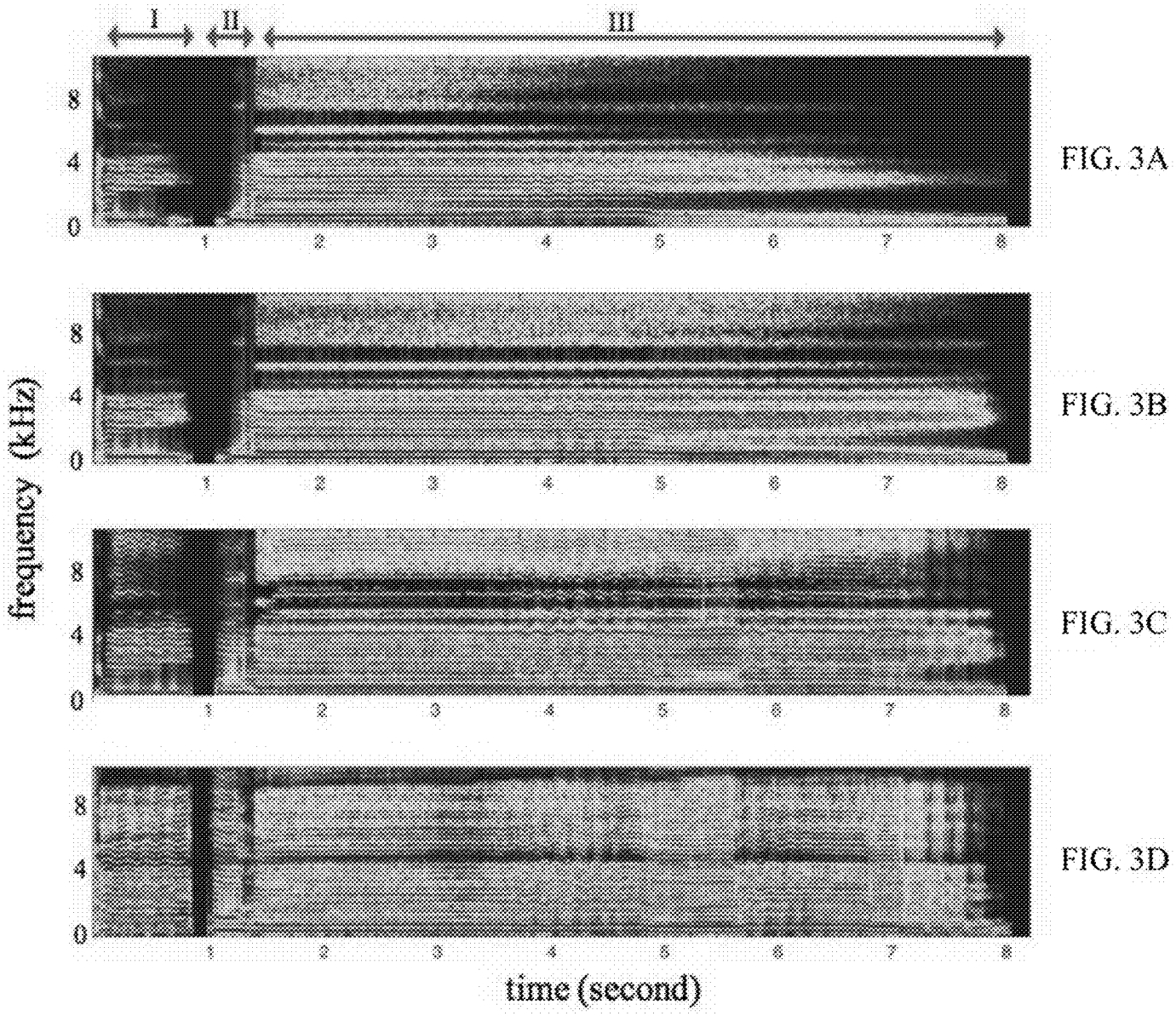
FIGS. 3A-3D are a plurality of spectrographs, in accordance with one embodiment of the present invention.

The effect of ENTW module 140 is illustrated in waveform outputs in FIGS. 2A-2D and in the corresponding spectrographs in FIGS. 3A-3D. For example, FIGS. 2A and 2B are the signal outputs of the phonetic alignment module 130 and ENTW module 140, respectively. FIGS. 2A and 3A represent the waveform and spectrum, respectively, from phonetic alignment module 130 before elongation, while FIGS. 2B and 3B represent the waveform and spectrum, respectively, from ENTW module 140 after elongation. Similarly, FIGS. 2C and 3C represent the waveform and spectrum, respectively, from vocalic timbre interpolator 160, which is discussed in more detail below. The template waveform is provided as a reference in FIG. 2D along with the corresponding spectrum in FIG. 3D.

The timing information at the top of FIGS. 2A and 3A indicate that the signal has three vowel segments—namely I, II, and III. In FIG. 2A-2D, we can see that the amplitude of both vowels I and III fades toward the end of the segments, which is a characteristic of poor singing voice quality compared to the template song shown in FIG. 2D.

After the ENTW module 140, the high-energy interval frames are elongated, which is illustrated by the waveform in FIG. 2B and in the frequency domain in FIG. 3B. In FIG. 3A, the high frequency content of vowel III fades after 5 seconds but appears fuller in FIG. 3B. In other words, the high-energy part is stretched and the low-energy is compressed in such a way that the length of both vowels remain the same. It can be seen that the spectral content of the last parts of both vowels are fuller than the signal without ENTW.

In the preferred embodiment, the TTTS system also performs interpolation of the vocalic timbre based on F0. Our "vocalic library" 150 refers to a collection of recordings of vowel exemplars where a skilled singer sings each vowel at different pitch levels (e.g, low, mid, and high). We found that recordings at different pitch levels have different spectral envelopes, so exemplars at several pitches are needed for accuracy. The recording process is done offline once and the vocalic library 150 can be used with any singing voice.

For each vowel segment provided as input to the ENTW module 140, the phonetic label (extracted from the template timing) is used to query which vowel exemplars to use from the vocalic library 150. The vocalic timbre interpolator 160 then determines the best pitch level(s) with which to construct the exemplar features based upon the pitch in the song template ($F0_T$). Since the limited number of pitch levels cannot cover all pitch values, we estimate the MGC features $X_C$ (n, k) at a certain pitch by linear interpolation from the exemplars whose FU averages closest to the F) of that particular frame. It is possible that the vocoder may detect a voiced frame as unvoiced, so we select the minimum BAP value of the exemplars (higher voicing degree), i.e., $Y_C$ (n, k)=min{$Y_1$(n, k), $Y_2$(n, k)} for each frequency bin k and frame n.

The acoustic feature fusion module 170, also known as block D, generates the resulting acoustic features (MGC, BAP, F0) 172 after processing the ones given as input by ENTW module 140 and vocalic timbre interpolator 160. These acoustic features 172 are then used in a vocoder, i.e., waveform reconstruction module 180, to generate the sound waveform from three sources of information: TTS-based features 142, vowel exemplars 162, and the singing template.

The acoustic feature fusion module 170 generates a hybrid MGC by merging the MGC derived from the lyrics with the MGC derived from the singing voice. In particular, the acoustic feature fusion module 170 keeps the first K coefficients of $X_B$ (n, k) but replaces the remaining coefficients starting with K+1 with the MGC from the singing voice, namely $X_C$ (n, k). Thus, the low-order coefficients are derived from the phonemes derived from the lyrics after dynamic time warping while the high-order coefficients are derived from the singing voice.

From our inspection, we found that K=30 is an appropriate order that adds some spectral content (from the exemplar voice) to high frequencies while still maintaining the identity of the virtual singer. Note that this procedure is only executed in vowel frames.

To reduce an abrupt change of the MGC values at the vowel segment boundaries, we gradually increase the effect of the exemplar coefficient values when transitioning from non-vowel frames to vowel frames. We achieve this by using a ramp function with 4 defining points as ($M_1$, $M_2$, $M_3$, $M_4$) in order (shown in FIG. 4). To transition between a vowel and a non-vowel segment, we use a ramp function $r_V(n)$ defined by ($N_1$, $N_1$+L, $N_2$−L, $N_2$) with the ramp length L. In other words, the MGC at this stage is defined as:

$$X_V(n,k)=r_V(n)X_C(n,k)+(1-r_V(n))X_B(n,k)$$

for k>=K and $X_V$ (n, k)=$X_B$ (n, k) for k<K.

In addition, we utilize the energy contour and spectral tilt of the template to further enhance the features. To do so, we take the average of $X_V$ and $X_T$ instead of only $X_T$ in order to avoid amplitude instability in the reconstructed waveform, which can occur when the modified C0 contour significantly differs from the original values. We found that applying the same process for the second coefficient C1 also makes the output have more singing characteristics.

We found that the above process works well for sonorant phonemes (e.g, vowels, semivowels, or nasals). However, obstruent phonemes (plosives, fricatives, and affricates) are short and turbulent, making the process unreliable. For this reason, we keep the intervals near the boundaries close to the output of the baseline with a margin ramp of length M as a leeway when applying a ramp function to transitions between obstruents and sonorants. The ramp function $r_D$ (n) is defined by ($N_1$−L−M, $N_1$−M, $N_2$+M, $N_2$+M+L) where L, $N_1$ and $N_2$ are the ramp length and the first and last sample of the obstruent segments, respectively. Or mathematically given by:

$$X_D(n,k)=r_D(n)X_B(n,k)+(1-r_D(n))((X_V(n,k)+X_T(n,k))/2)$$

for k=0 and 1.

FIG. 3C shows that the spectral and voice characteristics improve after feature fusion. By comparing FIGS. 3B and 3C, the high frequency content (>4 kHz) in all vowel segments is more visible indicating that the high-frequency energy and formants are enhanced, resulting in a richer or fuller voice. We can notice a difference in segment II where the spectral content is barely visible in the baseline but relatively full in the enhanced output. In segment III, the spectral content above 6 kHz has higher energy, clearer formants, and higher voicing.

In 5 to 8 seconds, the harmonic structure in FIG. 3C is much clearer than the baseline, suggesting voicing, which is expected in a vowel segment. The overall spectral characteristics are also similar to that of the template in FIG. 3D. The improvement is also evident in the time domain where the waveform is shown losing most of its energy very quickly. The overall amplitude envelope of the enhanced signal in FIG. 2C is similar to that of the template waveform in FIG. 2D, including modulation details that make the singing voice more pleasant. Clearly, the waveform in FIG. 2C preserves the same energy progression as the template waveform in FIG. 2D. The amplitude of vowel segment II is also dramatically lifted. Note that the output shown in FIG. 2C is without amplitude scaling in the time domain. The similarity between the amplitude contour of the enhanced output and that of the template song therefore suggests the effectiveness of the feature fusion technique.

The TTTS singing voice is generated using the WORLD vocoder with time-aligned features (MGC and BAP) and the template pitch contour 172 derived from the waveform reconstruction module 180, also referred to herein as block E. The short-term energy contour of the synthesized singing is scaled by the amplitude scaling module 190, also referred to herein as block F, to match that of the template. Finally, the resulting singing voice is mixed with the corresponding instrumental content and the complete waveform transmitted to an audio speaker 199, for example, for the benefit of the user.

Figure 5:
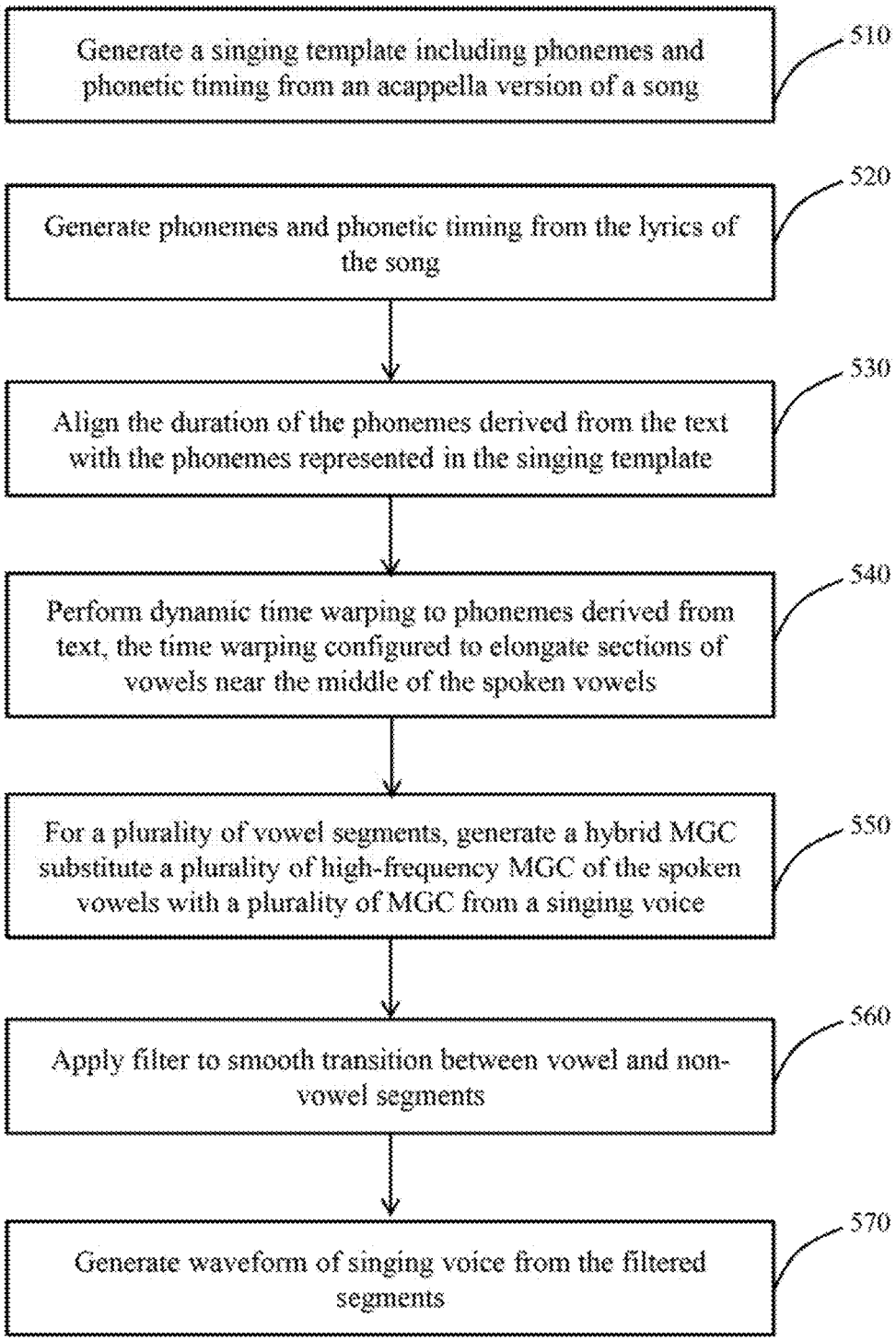
FIG. 5 is a flowchart of the method of generating singing from text, in accordance with one embodiment of the present invention.

Illustrated in FIG. 5 is a method of generating a singing voice in accordance with a preferred embodiment of the present invention. First, the TTTS system generates 510 a singing template including phonemes and phonetic timing from an acappella version of a song. It then generates 520 phonemes and phonetic timing from the lyrics of the song. The duration of the phonemes derived from the text are then aligned 530 with the phonemes represented in the singing template. Dynamic time warping is then used on phonemes derived from text to elongate 540 vowels near the middle of the spoken vowels. For a plurality of vowel segments, substitute 550 a plurality of high-order MGC of the spoken vowels with a plurality of MGC from a singing voice. A filter is applied 560 to smooth the transition between vowel and non-vowel segments when concatenated into a waveform. A waveform of singing voice from the filtered segment is then generated 570 and the waveform outputted to a cell phone, computer, or other speaker for playback by a user.

We have presented a TTS-based singing framework as well as techniques to enhance the singing voice output. The energy-based nonlinear time warping (ENTW) algorithm appropriately stretches and compresses different portions in each vowel to reduce low-energy intervals. The timbre of the signals are enhanced by supplementary vowel recordings from our vocalic library. The feature fusion algorithm combines the information from the enhanced timbre, the ENTW output, and the reference template to improve the contours of energy and aperiodicity of the singing voice. The listening test validates that the enhanced singing was perceived with higher quality than the baseline framework without the enhancement techniques. Additionally, the enhancement techniques are flexible to use with different voices. Future work will include validating the system with more languages. In addition, we plan to further investigate the different characteristics between speech and singing such as the dynamics of formant frequencies, aperiodicity, and consonants. We also plan to develop other enhancement techniques and utilize other useful information from the template reference to further improve the quality of the singing voices.

One or more embodiments of the present invention may be implemented with one or more computer readable media, wherein each medium may be configured to include thereon data or computer executable instructions for manipulating data. The computer executable instructions include data structures, objects, programs, routines, or other program modules that may be accessed by a processing system, such as one associated with a general-purpose computer, processor, electronic circuit, or module capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system. Examples of mass storage devices incorporating computer readable media include hard disk drives, magnetic disk drives, tape drives, optical disk drives, and solid state memory chips, for example. The term processor as used herein refers to a number of processing devices including electronic circuits such as personal computing devices, servers, general purpose computers, special purpose computers, application-specific integrated circuit (ASIC), and digital/analog circuits with discrete components, for example.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

We claim:

1. A text-to-singing system comprising:

a singing template comprising lyrics of a song, and template timing associated with the song;

a text-to-speech system configured to generate:

a) a plurality of phonemes from the lyrics, b) phonetic timing for each of the plurality of phonemes, and c) acoustic features for each of the plurality of phonemes;

a phonetic alignment module configured to temporally align the acoustic features to match the template timing, for each of the plurality of phonemes;

a dynamic time warping module configured to elongate phonemes associated sections of vowels;

a vocalic timbre interpolator configured to generate a plurality of Mel-generalized cepstrum (MGC) for a plurality of phonemes from a singing voice;

an acoustic feature module configured, for a plurality of phonemes, to:

a) generate a plurality of MGC for the plurality of phonemes from the lyrics; and b) generate a hybrid MGC comprising:

i) a plurality of MGC from the lyrics, and ii) a plurality of MGC from the singing voice; and a waveform generator configured to generate a waveform with the hybrid MGC.

2. The text-to-singing system of claim 1, wherein the plurality of MGC from the lyrics comprise low-order MGC, and the plurality of MGC from the singing voice comprise high-order MGC.

3. The text-to-singing system of claim 2, wherein plurality of MGC from the lyrics comprising low-order MGC comprise about 30 MGC.

4. The text-to-singing system of claim 1, wherein the vocalic timbre interpolator is configured to generate a plurality of Mel-generalized cepstrum (MGC) for a plurality of phonemes via interpolation of a plurality of singing voice exemplars.

5. The text-to-singing system of claim 1, further comprising a filter configured to smooth transitions between vowel and non-vowel segments.

* * * * *